US005395059A

United States Patent [19]

Satake et al.

[11] Patent Number: 5,395,059

[45] Date of Patent: Mar. 7, 1995

[54] SPACER FOR ABRASIVE ROLL OF ABRASIVE TYPE GRAIN MILLING MACHINE

[75] Inventors: Toshihiko Satake, Higashihiroshima; Satoru Satake, Tokyo; Yutaka Okada; Shigeru Ariji, both of Higashihiroshima, all of Japan

[73] Assignee: Satake Corporation, Tokyo, Japan

[21] Appl. No.: 202,788

[22] Filed: Feb. 28, 1994

[30] Foreign Application Priority Data

Mar. 23, 1993 [JP] Japan ..... 5-089237

[51] Int. Cl.[6] ..... B02C 7/13

[52] U.S. Cl. ..... 241/74; 241/49; 241/257.1

[58] Field of Search ..... 241/6–13, 241/74, 49, 57, 58, 162, 163, 242, 247, 248, 257.1

[56] References Cited

U.S. PATENT DOCUMENTS

| | | | |
|---|---|---|---|
| 1,794,972 | 3/1931 | Mayer | 241/248 |
| 3,411,721 | 11/1968 | Delcellier | 241/257.1 X |
| 3,434,672 | 3/1969 | Guin | 241/257.1 X |
| 3,519,431 | 7/1970 | Wayne | 241/6 X |
| 5,025,993 | 6/1991 | Satake | 241/74 |
| 5,295,629 | 3/1994 | Satake et al. | 241/74 |

FOREIGN PATENT DOCUMENTS

| | | |
|---|---|---|
| 26-6411 | 10/1926 | Japan . |
| 26-6412 | 10/1926 | Japan . |
| 32-3020 | 5/1932 | Japan . |
| 34-17145 | 10/1934 | Japan . |
| 49-89258 | 8/1974 | Japan . |
| 1577979 | 10/1980 | United Kingdom . |

*Primary Examiner*—Timothy V. Eley
*Attorney, Agent, or Firm*—Darby & Darby

[57] ABSTRACT

An abrasive type vertical grain milling machine in which each of spacers comprises a boss portion fitted on a main shaft and a plurality of arm portions extending from the boss portion in the radially outwardly and serving to induce bran removing air into a grain milling chamber through spaces between the circumferentially adjacent arm portions, is capable of discharging bran produced in the grain milling chamber with high bran discharging power and has little possibility that the bran removing power is reduced during operation.

9 Claims, 6 Drawing Sheets

SPACER FOR ABRASIVE ROLL OF ABRASIVE TYPE GRAIN MILLING MACHINE

FIELD OF THE INVENTION

The present invention relates to a vertical grain milling machine in which grains to be milled are introduced into a grain milling chamber from one vertical end of the grain milling chamber and grains having been milled are discharged from the other end and more particularly, to an abrasive type vertical grain milling machine of the type that comprises an abrasive roll assembly mounted on a maim shaft extending straight in the vertical direction and Waving a plurality of roll elements fitted on the main shaft while being spaced by means of a spacer from each other in the direction in which the main shaft extends, and a porous or perforated hollow cylindrical body extending vertically around the roll assembly leaving a space therefrom so as to form a cylindrical grain milling chamber around the roll assembly in cooperation with the outer peripheral surface of the roll assembly and having a large number of holes or perforations through which bran produced in the grain milling chamber is allowed to be released.

It is noted that grain to be milled is not limited to rice grain but may be other grain such as wheat grain or coffee bean.

DESCRIPTION OF RELATED ART

Japanese Utility Model Unexamined Publication No. 49-89258 discloses an abrasive type grain milling or polishing machine 204 in which, as shown in FIGS. 4 and 5, grains to be milled are introduced into a grain milling chamber 201 from one end 202 of the grain milling chamber 201 and grains having been milled are discharged from the other end 203 of the same in more detail, Japanese Utility Model Unexamined Publication No. 49-89258 discloses the abrasive type grain milling machine 204 of the type that comprises, as shown in FIGS. 4 and 5, an abrasive type grain milling roll assembly 206 mounted on a main shaft 205 and having a plurality of roll elements 208 fitted on the main shaft 205 while being spaced by means of a spacer 207 from each other in the direction in which the main shaft 205 extends, and a porous or perforated hollow cylindrical body 210 extending in parallel with the main shaft 205 around the roll assembly 206 leaving a space from the roll assembly 206 so as to form the cylindrical grain milling chamber 201 around the roll assembly 206 in cooperation with the outer peripheral surface of the roll assembly 206 and having a large number of holes or perforations 209 through which bran produced in the grain milling chamber 201 is allowed to be released.

Incidentally, reference numeral 211 denotes a hopper, 212 denotes a feed roll, 213 denotes an air blower driven through the medium of a pulley 214 and a belt and serving to deliver bran removing air into the abrasive roll assembly 206, numeral 215 denotes a resistance board serving to close with a specified pressing force a discharge port 216 for milled grain, and 217 denotes a bran removing chamber and bran discharge passage.

The spacer 207 of the grain milling machine 204 is annular in shape and is formed with an annular projection 219 having jet-air outlets or openings 218 formed in the axially central portion thereof.

As the pulley 214 is rotated by a suitable driving device, surfaces of grains supplied from the hopper 211 into the grain milling chamber 201 through the feed roll 211 are abraded or scraped off by the peripheral surface of the abrasive roll assembly 206 which is being rotated, thus performing the grain milling. On the other hand, the air blower 213 is driven through the pulley 214 so that bran removing air is made to pass through the interior space of the abrasive roll assembly 206 and jetted into the grain milling chamber 201 through the jet-air outlets 218 formed in the annular projection 219 of the spacer 207, with a result that bran produced by the grain milling performed in the grain milling chamber 201 can be discharged to the bran removing chamber 217 through the holes 209 in the cylindrical body 210.

However, in this kind of conventional grain milling machine 204, since the number and size of the jet-air outlets 218 are limited because of the limit of mechanical strength that is ought to be possessed by the annular spacer 207, increase of the flow rate of jet air is limited and hence the bran removing power is limited. Further, in this kind of conventional grain milling machine 204, since the size of the jet-air outlet 218 cannot be made so large the jet-air outlet 218 is liable to be clogged with grain and/or bran, thereby reducing the bran removing power easily.

Incidentally, the grain milling machine of the type that has jet-air outlets in a portion which serves substantially as the spacer is also disclosed in for example Japanese Patent Examined Publication No. 32-3020, Japanese Utility Model Examined Publication No. 34-17145 and so on.

Further, vertical grain milling machine of the type that has jet-air outlets in a portion which serves substantially as the spacer is disclosed in Japanese Patent Examined Publication Nos. 26-6411 and 26-6412 and British Patent Specification No; 1,577,979.

Particularly, British Patent Specification No. 1,577,979 discloses an abrasive type vertical grain milling machine 222 having a construction shown in FIG. 6 in which a plurality of spacer pins 220 are disposed circumferentially equidistantly between the adjacent roll elements 208 and 208 so as to make bran removing air jet into the grain milling chamber 201 through between the adjacent roll elements 208 and 208. It is noted that in FIG. 6, the same members and elements as those of FIGS. 4 and 5 are designated by the same reference numerals.

In the abrasive type vertical grain milling machine 222, by exhausting air through an exhaust pipe 223 in the direction of arrow mark P by making use of a fan, air stream is induced into a space 224 defined between the main shaft 205 and the abrasive roll assembly 206 from above and below as shown by arrow marks Q and R, and the induced air stream is jetted as bran removing air to the grain milling chamber 201 through the spaces 225 between the adjacent spacer pins 220 and between the adjacent roll elements 208 and 208, with a result that bran is released through the holes 209 in the porous or perforated cylindrical body 210 as shown by arrow mark S.

In the case of the grain milling machine 222, the space 225 serving as the jet-air outlet can be enlarged more easily than the hole 218 of the grain milling machine 204 of FIG. 4 and 5, and therefore, it is considered that the bran removing power can be increased rather easily and, hence, the fear of clogging of the space 225 with grain and/or bran can be reduced.

However, in the grain milling machine 222, it is considered that the spacer pin 220 is supported only by the opposite end faces of the adjacent roll elements 208 and 208 (no concrete description is made about this point in British Patent Specification No. 1,577,979), and therefore, there is a possibility that, if the vertical length of the space 225 is increased, to support the roll elements 208, 208 stacked through the plural spacer pins 220 becomes liable to be unstable. On the other hand, it is considered that, if the density of distribution of the pins 220 in the circumferential direction is increased in order to make it more stable to support the stacked roll elements, there is a fear of reduction of the circumferential effective length of the space 225. Accordingly, the grain milling machine 222 is considered also to have a possibility that bran removing air cannot be always jetted sufficiently through the spaces 225.

SUMMARY OF THE INVENTION

The present invention has been developed in view of the various points described above and an object of the invention is to provide an abrasive type vertical grain milling machine which is capable of discharging bran produced in a grain milling chamber with high bran discharging power and has little possibility that the bran removing power is reduced during operation.

According to the present invention, the above object can be achieved by an abrasive type vertical grain milling machine in which each of the spacers has a boss portion fitted on the main shaft and a plurality of arm portions extending from the boss portion radially outwardly and serving to induce bran removing air into the grain milling chamber through spaces between the circumferentially adjacent arm portions.

In the grain milling machine according to the present invention, since each spacer has the boss portion fitted on the main shaft, every spacer can be fixed to (around) the main shaft at the boss portion thereof sufficiently firmly. Further, in the grain milling machine according to the present invention, since the plural arm portions of each spacer extend respectively from the boss portion radially outwardly, every arm portion can be supported by the boss portion sufficiently soundly. As a result, in the grain milling machine according to the present invention, the spaces formed between the circumferentially adjacent arm portions can be made sufficiently large without reducing the mechanical supporting strength for the stacked roll elements. Accordingly, through the large spaces between the circumferentially adjacent arm portions of the spacer, bran removing air can be induced into the grain milling chamber at sufficiently high flow rate. In consequence, bran produced in the grain milling chamber can be discharged quickly out of the grain milling chamber due to bran removing air without clogging the spaces between the circumferentially adjacent arm portions of the spacer with grain(s) in the grain milling chamber and/or bran produced in the grain milling chamber Incidentally, the plural arm portions and the boss portion may be formed in an integral body either by being made of a single member or by uniting or fixing every arm portion with the boss portion by means of a connecting member such as bolt or screw or by means of welding or the like.

In a grain milling machine according to a preferred embodiment of the present invention, a thickness of the aforesaid arm portion in a main shaft-extending direction in which the main shaft extends is equal to a length of the boss portion in the main shaft-extending direction. In this case, since the adjacent roll elements can be supported at the axial end faces thereof not only by the boss portion but also by the arm portions the stacked roll elements can be supported soundly, with a result that the bran removing jet air spaces between the circumferentially adjacent arm portions of the spacer can be enlarged still more. Incidentally, in case that the axial length of the boss portion of the roll element is differed from the axial length of the outer peripheral abrasive cylinder portion of the roll element, the thickness of the arm portion of the spacer in the main shaft-extending direction, i.e. axial direction, may be differed from the length of the boss portion thereof in the main shaft-extending direction so as to enable the spacer to come in contact at both the boss portion and the arm portions thereof with the boss portion and the abrasive cylinder portion of the roll element, respectively.

In the grain milling machine according to a preferred embodiment of the present invention, the arm portion comprises a base portion or boss-side arm portion extending substantially in the radial direction and a tip or distal end portion extending as turning aside in the circumferential direction to be located on a side opposite to a direction of rotation of the arm portion as going toward radially outwardly. In this case, during the grain milling operation in which the main shaft is being rotated at a predetermined speed, bran removing jet air can be jetted generally in the radially outward direction through the bran removing jet air spaces between the circumferentially adjacent arm portions of the spacer, so that bran in the grain milling chamber can be discharged therefrom effectively. Incidentally, if desired, the arm portions may extend straight in the radially outward direction without being bent.

In the grain milling machine according to a preferred embodiment of the present invention, the tip end portion of the arm portion is tapered, i.e. convergent toward the tip or distal end. In this case, increase of the moment of inertia attributable to the radially outward portion of the arm portion can be suppressed, and therefore, even if the angular acceleration of rotation of the arm portion of the spacer is high, there is little possibility that the arm portion is deformed.

In the grain milling machine according to a preferred embodiment of the present invention, the cylindrical body comprises a resistance member which extends in parallel with the main shaft and which is adapted to project into the grain milling chamber in the radial direction for serving to impart resistance to movement of grains in the circumferential direction of the roll assembly, and the resistance member is formed with a circumferential groove in at least one of heightwise portions thereof facing to the spacers. In this case, due to the provision of the circumferential groove in the resistance member which serves to improve the grain milling effect, the risk that the resistance member prevents the jet of air can be reduced.

In the grain milling machine according to a preferred embodiment of the present invention, the main shaft is formed by a hollow shaft having a large number of ventilating through holes in a wall potion thereof, each of the roll elements comprises the boss portion fitted on the main shaft and having ventilating through holes to be communicated with the ventilating through holes of the main shaft, a plurality of arm portions extending from the boss portion radially outwardly, a cylindrical portion serving to connect radially outward end portions of the arm portions together into one body, and an abrasive cylinder portion fitted on this cylindrical portion, and the ventilating through holes of the boss portion of each roll element are opened in an outer peripheral surface of the boss portion thereof between the circumferentially adjacent arm portions thereof, bran removing air passed through the ventilating through holes of the main shaft and the ventilating through holes of the boss portion of the roll element being induced, after passing through spaces between the circumferentially adjacent arm portions of the roll element, into the grain milling chamber through the spaces between the arm portions of the spacer. In this case, the roll element can be supported at both the boss portion and the cylindrical portion thereof by the boss portion and the arm portions of the spacer. Incidentally, if desired, the boss portion of the spacer may have ventilating through-holes therein.

In the grain milling machine according to a preferred embodiment of the present invention, in each of the roll elements, a thickness of the arm portion thereof in the main shaft extending-direction is smaller than a length of the boss portion thereof in the main shaft-extending direction.

Incidentally, in each of the roll elements, a length of the boss portion thereof in the main shaft-extending direction is preferably equal to a length of the cylindrical portion and the abrasive cylinder portion thereof in the main shaft-extending direction.

The grain milling machine according to a preferred embodiment of the present invention further comprises a fastening means fastened to one end of the main shaft and serving to fix 4 stacked assembly of the roll elements and spacers as a unit by pressing down the same in the axial direction. In this case, the stacked assembly can be fixed to the main shaft easily and reliably by means of the fastening means.

Further, the grain milling machine, if desired, may be a friction type grain milling machine in which a friction type grain milling roll assembly is employed as the grain milling roll assembly.

DESCRIPTION OF PREFERRED EMBODIMENTS

Next, taking the case of whitening, i.e. polishing or milling, rice as the grain, an abrasive type vertical rice whitening machine, which is a preferred embodiment of an abrasive type vertical grain milling machine according to the present invention, will be described with reference to FIGS. 1 to 3.

Figure 1:
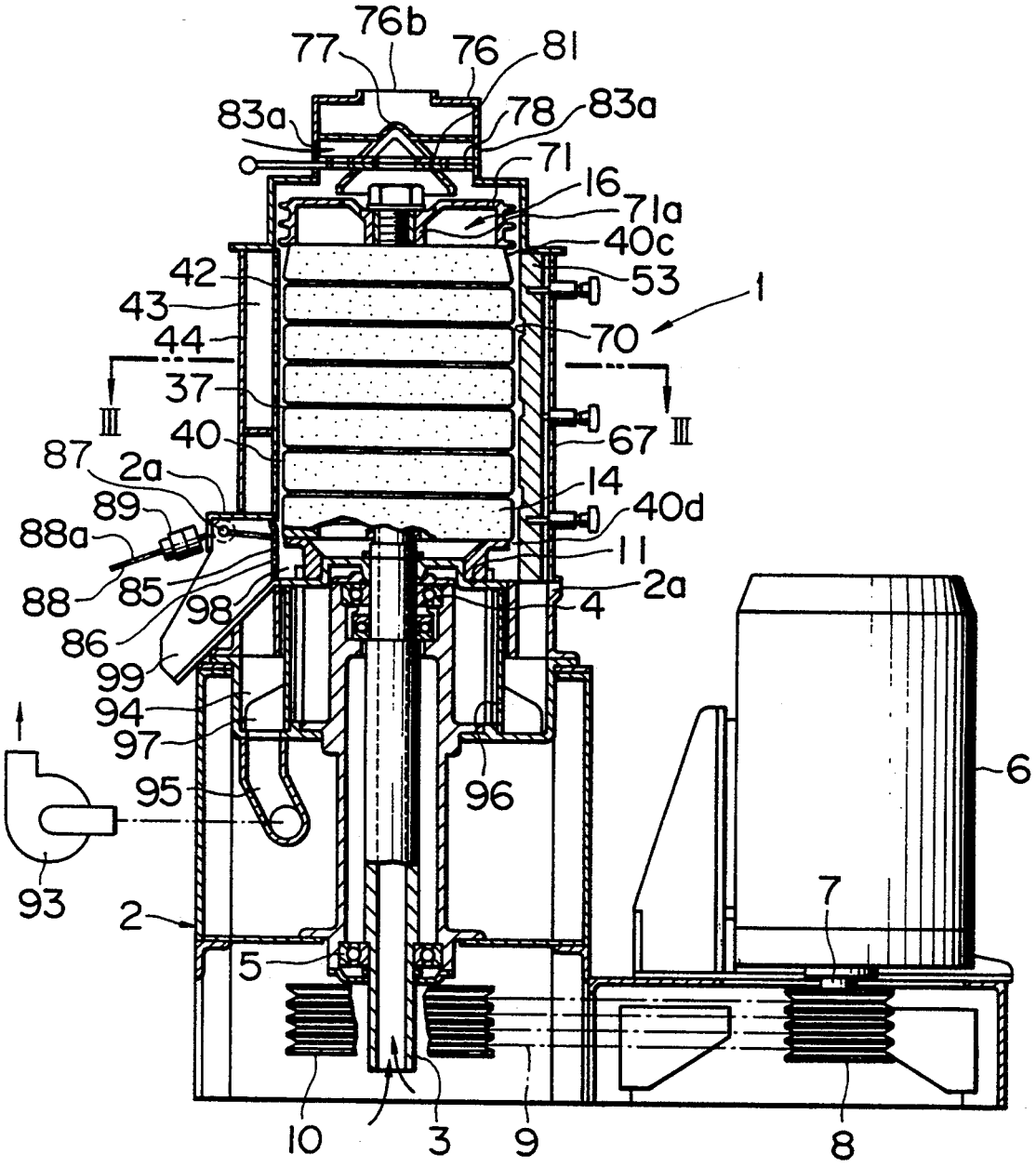
FIG. 1 is a vertical sectional view for illustrating an abrasive type vertical grain milling machine according to a preferred embodiment of the present invention (which is a sectional view of FIG. 3 taken along the line I—I)

In FIG. 1 which is a general vertical sectional view of an abrasive type vertical rice whitening machine 1, reference numeral 2 denotes a base. In the central portion of the base 2, a main shaft 3 formed by a hollow shaft extending in the vertical direction is rotatably supported by means of upper and lower bearings 4 and 5. A motor 6 is equipped sidewards of the base 2 so that rotation of an output shaft 7 of the motor 6 is transmitted through a pulley 7, a wedge belt or V belt 9 and a pulley 10 to the main shaft 3, thereby making the main shaft 3 rotate at a suitable rotational speed (generally at a rotational speed that the speed of an abrasive type roll assembly 16 to be described later becomes about 600 m/min at the outer peripheral surface thereof).

Figure 2:
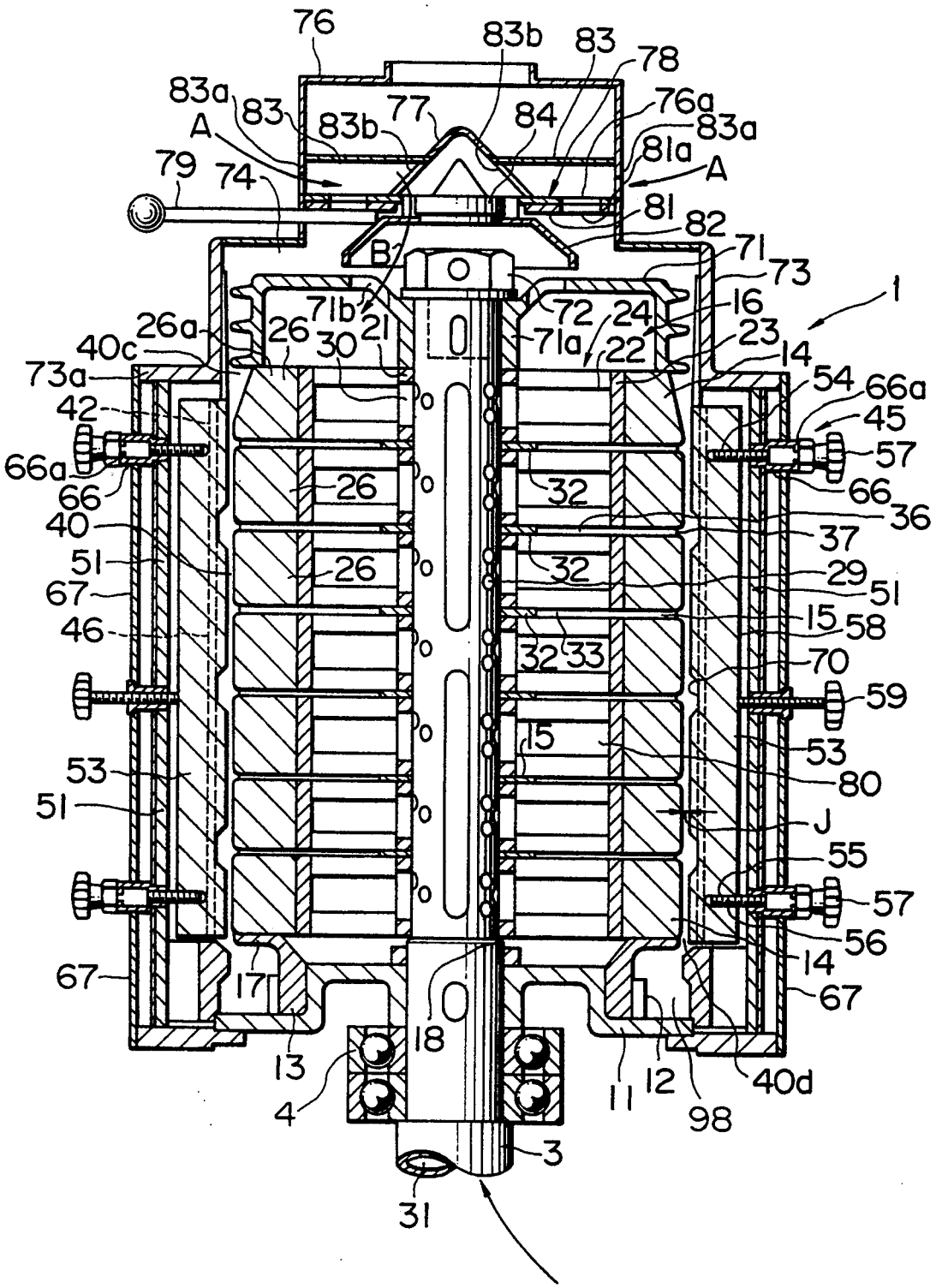
FIG. 2 is an enlarged similar sectional view for illustrating a part of the grain milling machine of FIG. 1.

As shown in FIG. 1 and FIG. 2 showing a part of FIG. 1 on an enlarged scale with the roll assembly in section, a rotary bottom member 11 having a cap-like cross-section is fixed to the main shaft 3 to be positioned above the upper bearing 4, and a ring-like support member 13 formed with stirring blades 12 serving to discharge white rice, i.e. milled rice grain; is fixed to the rotary bottom member 11.

The ring-like support member 13 has a radially outward flange portion 17 on which is supported a bottom portion of the abrasive type roll assembly 16 constituted by stacking a large number of abrasive type roll elements 14 through roll element spacer 15. The abrasive type roll assembly 16 is supported by a stepped portion 18 of the main shaft 3 as well.

Figure 3:
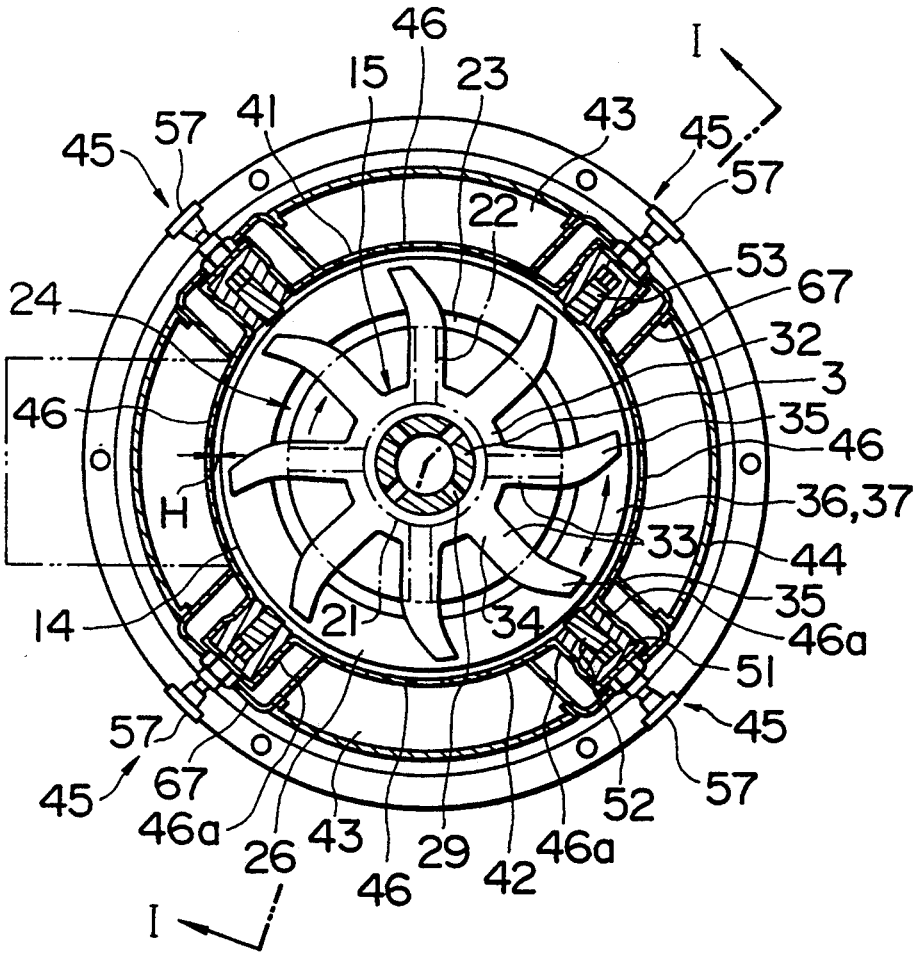
FIG. 3 is a cross-sectional view of the grain milling machine of FIG. 1 taken along the line III—III.
Figure 4:
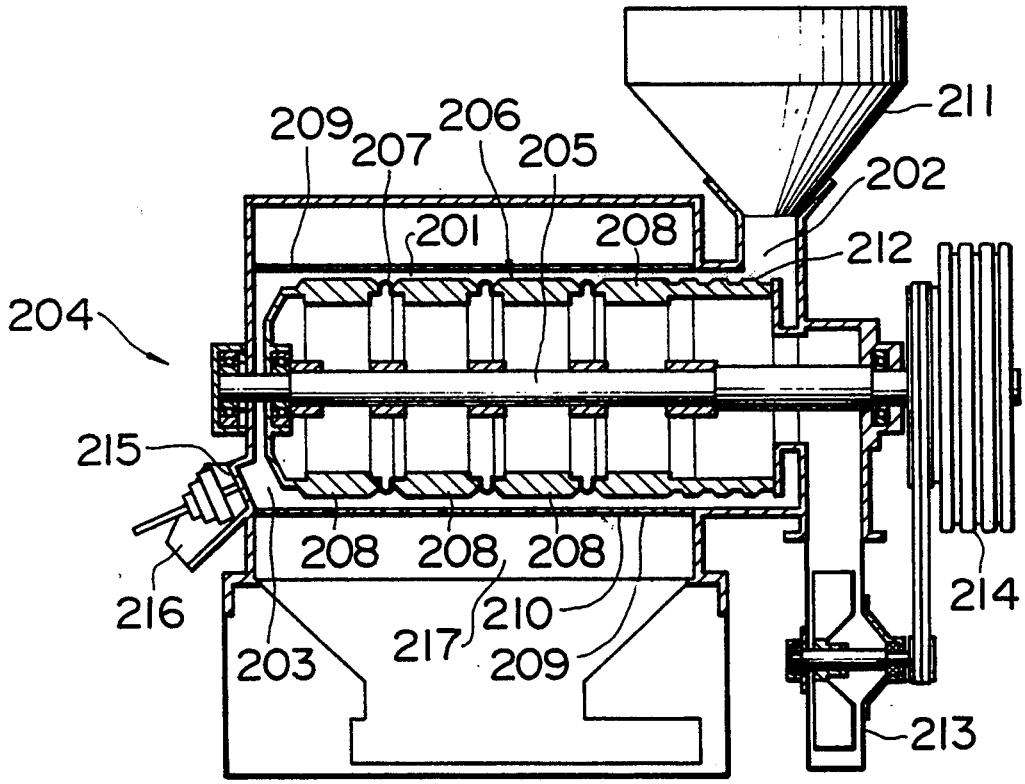
FIG. 4 PRIOR ART
FIG. 4 is a vertical sectional view for illustrating a conventional abrasive type grain milling machine.
Figure 5:
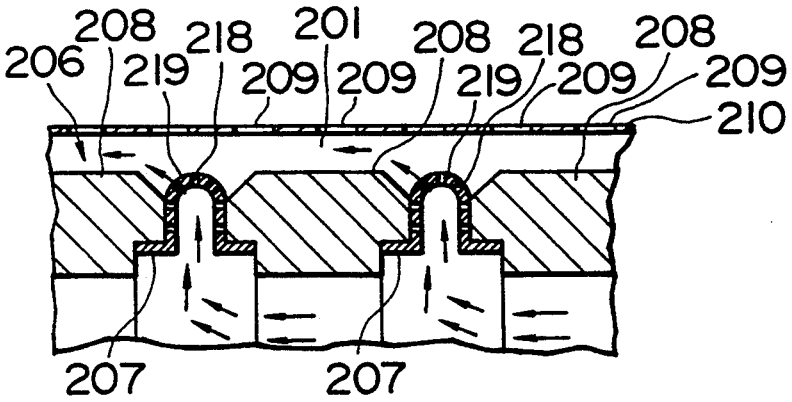
FIG. 5 PRIOR ART
FIG. 5 is an enlarged sectional view showing a part of the grain milling machine of FIG. 4.
Figure 6:
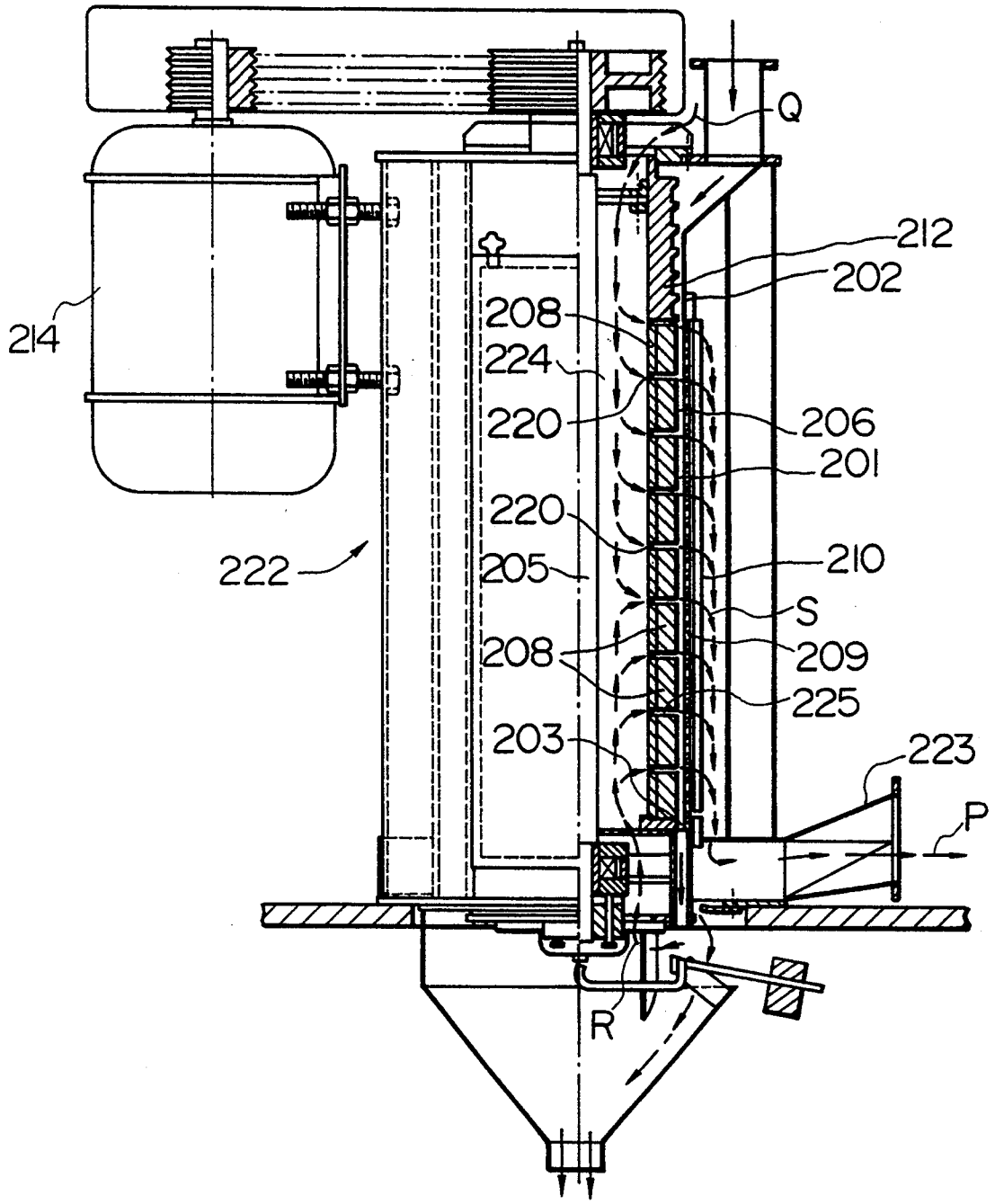
FIG. 6 PRIOR ART
FIG. 6 is a vertical sectional view for illustrating another conventional abrasive type vertical grain milling machine.

Each roll element 14 comprises a rigid abrasive cylinder support member 24 including a boss portion 21 fitted on the main shaft 3, a plurality of arm portions 22 formed integrally with the boss portion 21 and extending radially from the boss portion 21 and a cylindrical portion 23 formed integrally with the extended ends of the arm portions 22, and an abrasive cylinder 26 securely fixed to the cylindrical portion 23 of the support member 24 and formed by an abrasive wheel (an aggregate of emery particles (Carborundom)) (see FIG. 3 as well). Incidentally, as seen from FIG. 2, the length of the arm portion 22 in the vertical direction is smaller than the axial lengths of the boss portion 21 and of the cylindridal portion 23. The axial length of the boss portion 21 is equal to that of the cylindrical portion 23.

Further, among the abrasive cylinders 26, the uppermost abrasive cylinder, that is, an abrasive cylinder 26a located on the most upstream side of the flowing direction of rice grains to be whitened, is formed in the shape of a circular truncated cone in order to guide the flow of rice grains.

Moreover, the hollow main shaft 3 is formed with a large number of air holes 29 in the portion thereof where the abrasive type roll assembly 16 is fitted on, and the boss portion 21 of the abrasive cylinder support member 24 of each roll element 14 is also formed therein with air holes 30 in portions thereof between the circumferentially adjacent arm portions 22 and 22. Accordingly, in case that the abrasive cylinder support member 24 of the roll element 14 is fitted on the hollow main shaft 3, the air holes 30 in the boss portion 21 are communicated with the air holes 29 in the main shaft 3, thereby enabling air to flow from an interior space 31 of the hollow main shaft 3 to the inside of the abrasive cylinder 26 through the air holes 29 and 30.

On the other hand, each of the roll element spacers 15 comprises, as shown in FIG. 3, a boss portion 32 having a larger diameter than the boss portion 21 of the abrasive cylinder support member 24 and kept in contact at the end faces thereof with the end faces of the boss portions 21, and a plurality of arm portions 33 formed integrally with the boss portion 32 and extending substantially radially from the boss portion 32 and kept in contact with the end faces of the abrasive cylinder support members 24 so as to support the same. Each arm portion 33 comprises a boss-side arm portion or base portion 34 extending straight in the radial direction and a tapered or convergent tip end-side arm portion 35 extending radially outwardly from the end of the boss side arm portion 34 and inclined in a direction opposite to the direction of rotation of the spacer 15. In this embodiment, the spacer 15 has eight arm portions 33, and however, the number of the arm portions 33 may be either not greater than 7 (four or six, for example) or not smaller than 9. Further, the shape and size of the arm portions 33 are not necessarily identical but may be different alternately, for example. Moreover, the arm portion 33 may extend straight in the radially outward direction instead of turning aside in the tip end-side arm portion 35 thereof.

Accordingly, the air flowing out from the interior space 31 of the hollow main shaft 3 to the inside of the abrasive cylinder 26 through the air holes 29 and 30 is enabled to flow out radially outwardly through between the adjacent roll elements 14 and 14 passing through spaces 36 defiled between the adjacent arm portions 33 and 33 of ever roll element spacer 15. In other words, radially outward edge or end portions 37 of the spaces 36 serve as the bran removing jet-air outlets of the abrasive type roll assembly 16.

Around the abrasive type roll assembly 16 is disposed a porous or perforated hollow cylindrical body 42 which cooperates with the outer peripheral surface of the roll assembly 16 to form a cylindrical grain milling chamber, i.e. rice whitening chamber 40 around the roll assembly 16. The porous cylindrical body 42 extends vertically leaving a space, for the chamber 40, from the roll assembly 16 and has a large number of holes or perforations 41 through which bran produced in the rice whitening chamber 40 is allowed to be released. Around the porous cylindrical body 42 is disposed a cylindrical cover 44 which cooperates with the porous cylindrical body 42 to define a bran removing chamber 43 serving to collect and discharge the bran.

Incidentally, the porous cylindrical body 42 and the cylindrical cover 44 are set on and fixed to a support member 2*a* fixed to the base 2.

As shown in FIG. 3 the porous, i.e. perforated, cylindrical body 42 comprises four resistance imparting-adjusting mechanisms 45 disposed in such circumferential positions that the cylinder defined by the cylindrical body 42 is divided into four equal parts, and metallic porous or perforated arcuate plate members 46 serving to define cylindrical surface portions between the adjacent resistance imparting-adjusting mechanisms 45 and 45. Further, as seen from FIG. 2, the flow resistance imparting-adjusting mechanisms 45 and the porous arcuate plate members 46 are respectively formed to extend over the entire vertical length of the rice whitening chamber 40. A distance H between the inner peripheral surface of the porous arcuate plate member 46 and the outer peripheral surface of the abrasive roll element 14 is in the range of out 10~15 mm for example. The distance H is in a certain range that enables grains to roll over when subjected to the abrasive action and is decided in accordance with various factors such as the kind of grains to be milled, size of emery particles of the abrasive roll element 14, and rotational speed of the abrasive roll element 14.

Each flow resistance imparting-adjusting mechanism 45 comprises a stanchion or support post 51 extending in the vertical direction and having a substantially U-letter form cross-section, a prismatic resistance claw 53 fitted disengageably or radially movable in a concave portion 52 which extends in the vertical direction of "U" of the stanchion 51 and opens up radially inwardly, knob bolts 57, 57 screwed in upper and lower tapped holes 54 and 55 of the resistance claw 53 at an external thread portion 56 thereof for serving to adjust a radial position of the resistance claw 53 with respect to the stanchion 51 (in other words, a distance J between the resistance claw 53 and the abrasive roll element 14), and a set bolt 59 screwed in a tapped hole of the stanchion 51 for serving, in adjusting the position of the resistance claw 53, to fix the resistance claw 53 with respect to the stanchion 51 by making the tip end thereof come in contact with an outside end face 58 of the resistance claw 53.

Further, each porous arcuate plate member 46 i s fixed at circumferential end edge portions 46*a* thereof to the side wall of the stanchion 51 associated therewith. On the other hand, the stanchion 51 is fixed to the cylindrical cover 44 through a stanchion cover 67. The knob bolt 57 is prohibited from displacing in the axial direction thereof with respect to the stanchion 51 by means of a bolt retainer 66 fixed to the stanchion 51 and engaged with an annular groove of the knob bolt 57 at a caulking end portion 66*a* thereof.

Moreover, as designated by reference numeral 70 in FIGS. 1 and 2, in order to prevent jet-air outlets 37 and the vicinity thereof from being clogged with rice grain(s), grooves are formed in the resistance claw 53 in some (or every) portion thereof facing on the jet-air outlet 37.

Reference numeral 71 denotes a hollow bottomless feed roll having a feed screw on the outer peripheral surface thereof. Thee feed roll 71 is set on the uppermost roll element 14 by fitting a boss portion 71*a* thereof on the main shaft 3 and securely fixed to the main shaft 3 together with the abrasive roll assembly 16 by means of a bolt 72 screwed in a tapped hole formed in the upper end of the main shaft 3. Further, reference numeral 73 denotes a feed cylinder which forms a supply chamber 74 of rice grains to be whitened in cooperation with the feed roll 71, and a flange portion 73*a* at the lower end of the feed cylinder 73 is set on and fixed to the upper end of the stanchion 51 and the cylindrical cover 44, and constitutes a part of the frame of the rice whitening machine 1.

In addition, reference numeral 76 denotes a hopper into which rice grains to be whitened is thrown, 77 denotes an upper rice grain guide member formed in the shape of a hollow cone, and 78 denotes a feed amount regulating gate. At the gate 78, a handle 79 is operated by hand to adjust the position of a movable plate 81 with openings 81*a* with respect to bottom openings 76*a* of the hopper 76, so that the amount of rice grains to be fed from the hopper 76 into the supply chamber 74 is regulated. Reference numeral 82 denotes a lower guide member formed in the shape of a circular truncated cone and serving to feed rice grains introduced through the gate 78 into the supply chamber 74 while dispersing the same.

Moreover, the hopper 76 is provided with suction pipes 83 extending radially at equal angular intervals and serving to induce air for removing bran or the like. Each suction pipe 83 is opened in the peripheral wall of the hopper 76 at one end 83*a* thereof, while it is opened in the wall portion of the upper guide member 77 at the other end 83*b* thereof. Accordingly, air induced through the openings 83*a* in the direction of arrow mark A is made to flow through within the suction pipes 83 and the hollow upper guide member 77, enter into a central opening 84 of the lower guide member 82, further flow through within the lower guide member 82 and an upper opening 71*b* of the feed roll 71 and, then, enter into an interior space 80 of the abrasive roll assembly 16, as indicated by an arrow mark B.

Reference numeral 85, in FIG. 1, denotes a resistance board provided at a discharge port 86 through which rice grains having been whitened in the rice whitening chamber 40 is discharged. The pressing force applied to rice grains in the rice whitening chamber 40 by the resistance board 85 is defined by adjusting the position of a weight 89 screwed to one arm 88*a* of a lever 88 pivotally supported by a pivot shaft 87.

Reference numeral 93 denotes a bran collecting fan or blower which serves to release bran, collected in a bran collecting chamber 94 formed at the bottom of the bran removing chamber 43, through an exhaust pipe 95. Incidentally, a bottom cylindrical member 96 defining the inner peripheral wall of the bran collecting chamber 94 is fixed to the rotary bottom member 11, and the bottom cylindrical member 96 is provided with scraping blades 97 serving to promote the discharge of bran from the bran collecting chamber 94 when the bottom cylindrical member 96 is rotated together with the lower rotary bottom member 11. Reference numerals 98 and 99 denote respectively a collector portion and a chute.

Next, description will be given of handling and operation of the rice whitening machine 1 which is a preferred embodiment of the abrasive type vertical grain milling machine according to the present invention and has the construction described above, with reference to FIGS. 1 to 3.

First, the rice whitening conditions of the abrasive type vertical rice whitening machine 1 are set and adjusted in accordance with the characteristic of rice grains to be whitened.

More specifically, in accordance with various grain factors such as the shapes of rice grain determined based on the sizes of rice grain in both major and minor axes thereof before and after rice whitening, and the thickness and hardness of surface layer of rice grain to be removed by the rice whitening machine 1, the positions of the resistance claws 53 are adjusted by handling the knob bolts 57 and the set bolts 59 while considering various machine factors such as the diameter and rotational speed of the abrasive roll assembly 16, the abrasive characteristic of the abrasive roll element 14, and the bran removing characteristic of the bran removing system including the exhaust fan 93. Incidentally, after observing a part of the rice grains having been whitened and discharged, readjustment may be made if necessary.

On the other hand, by adjusting the position of the weight 89 on the lever 88*a*, the pressing force of the resistance board 85, that is, the pressure applied to rice grains in the rice whitening chamber 40 by the resistance board 85 is regulated.. Incidentally, this pressure regulation may be performed during the rice whitening as well.

After the initialization described above, rice grains to be whitened are thrown into the hopper 76 through an inlet 76*b* while the gate 78 is closed. The motor 6 is started to rotate the abrasive roll assembly 16 and the feed roll 71 through the main shaft 3, and the bran collecting fan 93 is started so as to begin blowing of air for bran removing.

Subsequently, the handle 79 is operated to open the feed amount regulating gate 78 so that rice grains to be whitened are started to be introduced into the supply chamber 74 from the hopper 76. In this case, rice grains are supplied continuously into the supply chamber 74 as being dispersed uniformly in the circumferential direction by means of the upper and lower guide members 77 and 82. Rice grains received in the supply chamber 74 is fed continuously to the upper end 40*c* of the rice whitening chamber 40 by means of the feed roll 71.

In the steady state of the rice whitening operation of the rice whitening machine 1, rice grains supplied in the rice whitening chamber 40 come downwards gradually while rolling and rotating or revolving (i.e. moving around the main shaft in circular motion) violently under the relatively low pressing force between the stationary porous or perforated cylindrical body 42 and the rotating abrasive roll assembly 16, during which the surfaces of rice grains are made to come in contact with the abrasive cylinder 26 of the roll element 14 of the abrasive roll assembly 16 so as to be abraded or scraped off by the abrasive cylinder 26. In more detail since rice grains are likely to be caught between the resistance claw 53 and the abrasive roll assembly 16 when they reach the resistance claw 53, the rotating speed thereof is reduced under the influence of braking action and a large difference comes out between the rotating (revolving) speed thereof and the rotational speed of the abrasive roll assembly 16 with a result that the surface of rice grain is scraped off by being rubbed intensively by the emery particles of the abrasive cylinder 26 of the roll assembly 16. Further, since the resistance claws 53 each have the function of braking intermittently the general or collective flow of rice grains in the rice whitening chamber 40, the rolling speed and the rotating speed of rice grains in the rice whitening chamber 40 are changed intermittently, with a result that the rice whitening proceeds gradually. Moreover, since the relation between the rolling speed and the rotating speed of rice grains can be changed delicately by the adjustment of the resistance claws 53 the shape of rice grains to be discharged after whitening can be also changed by making use of this relation.

In addition, since the predetermined exit pressure is applied to the rice whitening chamber 40 by the resistance board 85 which is applied with the force of the weight 89, in case of whitening rice in the aforementioned manner, rice grains are ground and whitened or polished in the state that they are filled in the rice whitening chamber 40 at a suitable density so far as rice grains are allowed to flow continuously.

Rice grains having been whitened are collected in the collector portion 98 below the lower end 40*d* of the rice whitening chamber 40. Rice grains in the collector portion 98 are discharged through the chute 99 by opening the bottom resistance board 85 against the pressing force of the weight 89 while being stirred by the rotary stirring blades 12 attached to the lower rotary bottom member 11.

Meanwhile, as the fan 93 is operated, air is exhausted through the exhaust pipe 95. Therefore, on the one hand, air is induced through the openings 83*a* in the side wall of the hopper 76 into the interior space 80 of the abrasive roll assembly 16 via the suction pipes 83, the interior space of the upper guide member 77, the opening 84, the interior space of the lower guide member 82, the upper opening 71*b* of the feed roll 71, and the interior space of the feed roll 71, while, on the other hand, air is induced to the interior space 80 of the abrasive roll assembly 16 through the air holes 29 and 30 connected with the inside passage 31 of the main shaft 3. Air fed into the interior space 80 of the abrasive roll assembly 16 is blown off into the rice whitening chamber 40 through the portions located at the radially outward edge portions of the jet-air spaces 36 defined between the horizontally or circumferentially adjacent arm portions 33, 33 of each spacer 15 and between the vertically or axially adjacent abrasive cylinders 26, 26 of the roll elements 14, 14, that is, through the jet-air outlets 37. Air jetted into the rice whitening chamber 40 is accompanied with bran and other powdered matter existing in the rice whitening chamber 40 when it is jetted out through the holes of perforations 41 of the porous or perforated cylindrical body 42 into the bran removing chamber 43, and therefore, bran and other powdered matter in the rice whitening chamber 40 can be discharged to the bran removing chamber 43.

Further, since it is possible in the rice whitening machine 1 to form the jet-air outlet 37 sufficiently large without reducing the mechanical strength of the spacer 15 and the bearing strength of the spacer 15 for supporting the roll element 14, the bran removing air flow can be increased sufficiently as required, thereby making it possible to improve the bran removing power satisfactorily. Moreover, since the jet-air outlet 37 can be formed large, there is little possibility that the jet-air outlet 37 is clogged with grain and/or bran.

Incidentally, the stream of air within the rice whitening chamber 40 not only promotes the stirring of rice grains in the chamber 40 but also suppresses the rise of temperature of rice grains in the rice whitening chamber 40. Further, since the resistance claw 53 is formed with the inner circumferential groove or concave portion 70, there is little possibility that the jet-air outlet 37 is clogged with rice grains and/or bran even if the resistance claw 53 is present. The bran in the bran removing chamber 43 is collected into the bran collecting chamber 94 and scraped out by the scraping blades 97. Moreover, the rice grain and/or bran which happens to come into the depth of the jet-air outlet 37 can be returned to the rice whitening chamber 40 due to the centrifugal force resulting from the rotation of the arm 33 as well.

Figure 7:
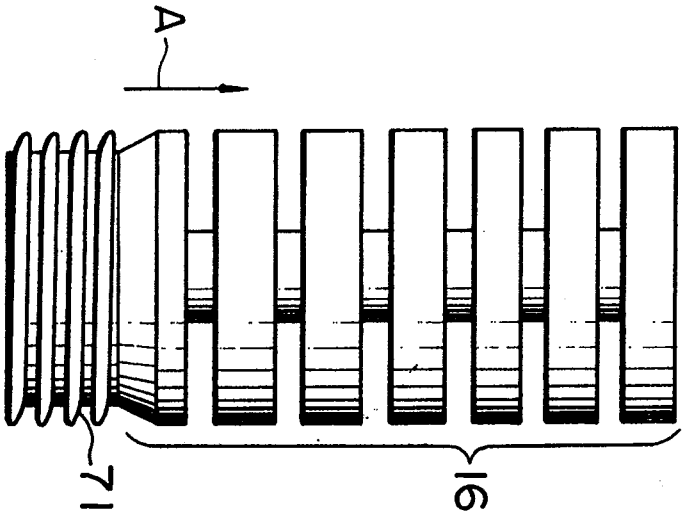
FIG. 7 is a view for illustrating the relation between an abrasive roll assembly and a feed roll in a modification of the abrasive type vertical grain milling machine of FIG. 1.

The above description has been made with reference to apparatus in which rice grains are whitened while being made to flow from top to bottom. However, an abrasive type vertical rice whitening machine of the lift type is also available in which the feed roll 71 is disposed below the abrasive roll assembly 16 so that rice grains are whitened while being made to flow from bottom to top in the direction of an arrow mark A as shown in FIG. 7.

The grain to be milled may be other grain such as wheat grain in place of rice grain. In this case, the grain milling conditions of the grain milling machine are changed in accordance with the differences, due to different grains, such as the grain size, as well as the thickness, hardness and the like of the surface layer to be removed.

Incidentally, the position adjusting mechanism of the resistance claw may be for example a piston-cylinder assembly and other like means in place of the knob bolt employed in the illustrated embodiment. Further, these may be the ones which are driven electrically or by fluid pressure.

Moreover, the above-described embodiment has been described as having two airflow passages as ventilating or air flow means, that is, the air flow passage leading from the openings 83*a* in the side wall of the hopper 76 through the suction pipes 83 and the like to the interior space 80 of the abrasive roll assembly 16 and the airflow passage leading through the inside passage 31 of the main shaft 3 and the air holes 29, 30 to the interior space 80 of the abrasive roll assembly 16, and however, it will do as well that either one of these airflow passages is provided alone.

Although some preferred embodiments and modifications have been described above with reference to the attached drawings, it is apparent that various modifications can be made within the spirit of the invention by a person skilled in the art.

What is claimed is:

1. An abrasive type vertical grain milling machine comprising:

an abrasive type grain milling roll assembly mounted on a main shaft extending straight in a vertical direction and having a plurality of roll elements fitted on said main shaft while being spaced by means of a spacer from each other in a main shaft-extending direction in which said main shaft extends; and a perforated cylindrical body extending vertically around said roll assembly leaving a space therefrom so as to define a cylindrical grain milling chamber around said roll assembly in cooperation with an outer peripheral surface of said roll assembly and having a large number of holes through which bran produced in said grain milling chamber is allowed to be released, grains to be milled being introduced into the grain milling chamber from a vertical one end of the grain milling chamber and grain having been milled being discharged from another vertical end of the same, wherein each said spacer comprises a boss portion fitted on the main shaft and a plurality of arm portions extending from said boss portion radially outwardly and serving to induce bran removing air into the grain milling chamber through spaces between the circumferentially adjacent arm portions.

2. An abrasive type vertical grain milling machine according to claim 1, wherein a thickness of at least one of said arm portions in the main shaft-extending direction is equal to a length of the boss portion in the main shaft-extending direction.

3. An abrasive type vertical grain milling machine according to claim 1, wherein at least one of said arm portions comprises a base portion extending substantially in the radial direction and a tip end portion extending radially outwardly and inclined in a circumferential direction opposite to a direction of rotation of the arm portion.

4. An abrasive type vertical grain milling machine according to claim 3, wherein the tip end portion of at least one of said arm portions is tapered.

5. An abrasive type vertical milling machine according to claim 1, wherein said cylindrical body comprises a resistance member extending in parallel with the main shaft and adapted to project into the grain milling chamber in the radial direction for serving to impart resistance to movement of grains in the circumferential direction of said roll assembly, and said resistance member is formed with a circumferential groove in at least one portion thereof facing one of said spacers.

6. An abrasive type vertical grain milling machine according to claim 1, wherein the main shaft comprises a hollow shaft having a large number of ventilating through holes in a wall portion thereof, each of said roll elements comprises a boss portion fitted on the main shaft and having ventilating through holes to be communicated with the ventilating through holes of the main shaft, a plurality of arm portions extending radially outwardly from said boss portion a cylindrical portion serving to connect radially outward end portions of the arm portions together into one body, and an abrasive cylinder portion fitted on said cylindrical portion, and the ventilating through holes of the boss portion of each roll element are opened in an outer peripheral surface of the boss potion thereof between the circumferentially adjacent arm portions thereof, bran removing air having passed through the ventilating through holes of the main shaft and the ventilating through holes of the boss portion of the roll element being induced, after passing through spaces between the circumferentially adjacent arm portions of said roll element, into the grain milling chamber through the spaces between said arm portions of said spacer.

7. An abrasive type vertical grain milling machine according to claim 6, wherein, in each of said roll elements, a thickness of said arm portion thereof in the main shaft-extending direction is smaller than a length of the boss portion thereof in the main shaft-extending direction.

8. An abrasive type vertical grain milling machine according to claim 7, wherein, in each of said roll elements, a length of the boss portion thereof in the main shaft-extending direction is equal to a length of each of the cylindrical portion and the abrasive cylinder portion thereof in the main shaft-extending direction.

9. An abrasive type vertical grain milling machine according to claim 1, further comprising a fastening means fastened to one end of the main shaft and serving to fix a stacked assembly of said roll elements and spacers as a unit by pressing down the same in the axial direction.

* * * * *